United States Patent [19]

Feldmeier

[11] 4,192,332

[45] Mar. 11, 1980

[54] VERTICAL LIQUID STORAGE TANK AND APPARATUS FOR CLEANING

[76] Inventor: Robert H. Feldmeier, 7632 Hunt La., Fayetteville, N.Y. 13066

[21] Appl. No.: 14,231

[22] Filed: Feb. 22, 1979

Related U.S. Application Data

[63] Continuation-in-part of Ser. No. 908,397, May 22, 1978, abandoned, and a continuation-in-part of Ser. No. 957,322, Nov. 2, 1978, and a continuation-in-part of Ser. No. 949,373, Oct. 6, 1978, and a continuation-in-part of Ser. No. 916,887, Jun. 19, 1978.

[51] Int. Cl.[2] ..... B08B 3/02; B08B 9/08

[52] U.S. Cl. ..... 134/167 R; 134/24; 137/583

[58] Field of Search .... 134/22 R, 24, 102, 166 R–168 R, 134/171; 137/583

[56] References Cited

U.S. PATENT DOCUMENTS

| | | | |
|---|---|---|---|
| 2,081,339 | 5/1937 | Rue et al. | 134/168 X |
| 3,113,046 | 12/1963 | Reddick et al. | 134/108 X |
| 3,599,871 | 8/1971 | Ruppel et al. | 134/168 X |
| 3,654,143 | 4/1972 | Kodera et al. | 134/24 X |

FOREIGN PATENT DOCUMENTS

| | | | |
|---|---|---|---|
| 372810 | 5/1932 | United Kingdom | 134/166 R |

*Primary Examiner*—Robert L. Bleutge
*Attorney, Agent, or Firm*—James Magee Jr.

[57] ABSTRACT

The specification discloses a liquid storage tank of the silo-type having spray cleaning apparatus for cleaning internal surfaces located in the lower portion of the tank and also cleanable venting and overflow conduits associated with the cleaning apparatus. The specification also describes a method for cleaning internal surfaces of the tank and its various conduits using spraying apparatus positioned at or near the bottom of the tank.

6 Claims, 6 Drawing Figures

VERTICAL LIQUID STORAGE TANK AND APPARATUS FOR CLEANING

This application is a continuation-in-part of co-pending applications Ser. No. 908,397 filed May 22, 1978, now abandoned; Ser. No. 957,322 filed Nov. 2, 1978; Ser. No. 949,373 filed Oct. 6, 1978; and Ser. No. 916,887 filed June 19, 1978.

BACKGROUND OF THE INVENTION

The instant invention is concerned with storage and processing of liquids and with the use and cleaning of such tanks. In particular, the invention concerns methods and apparatus for storing liquid food products such as milk, and methods and apparatus for cleaning vessels used for processing and holding liquid food products.

PRIOR ART

Storage tanks and vessels for the processing of liquid food products generally are provided in a variety of shapes and sizes with the emphasis, in recent years, being on large vertical tanks of large volume. Such tanks are generally referred to as silo tanks. Because of their size, cleaning after use and inspection of the interior of the tanks presents a substantial problem. The tanks are usually constructed with built in cleaning equipment including a spray nozzle at the top center of the tank and with ladders and catwalks for inspection and maintenance of the cleaning apparatus. Such a location for the cleaning solution spray nozzle makes it difficult to reach from inside the tank, thus exterior access is required. The exterior iron work, i.e., the ladder and catwalks, of course increase weight and cost of the tank but also impose additional strength requirements on the tank structure itself which must be strong enough to support the exterior structures.

In addition to the cleaning apparatus, the top of the tank is generally provided with conduits and equipment to prevent over filling of the tank and the development of internal-external pressure differentials during filling, draining, and cleaning operations. Such equipment usually takes the form of suitable tubes or conduits located in or near the top of the tank so that they are accessible from the ladders and catwalk used for access to the spray apparatus. The danger of tank damage during filling, draining, and cleaning is substantial because of the large capacity of silo tanks, sanitary precautions which limit air flow into and out of the tank, and the desire for rapid turn around of tank utilization which encourages utilization of high flow rates and the like.

LIQUID STORAGE TANKS

Silo tanks used for holding and cooling of liquid food products, such as milk and liquid milk products, are generally constructed of stainless steel or a similar material which is highly resistant to chemical reaction. Because of sanitary regulations, requirements, and practices, the tanks are usually constructed with interior surfaces which are designed to facilitate cleaning and sterilization. Tank interiors usually are free of crevices, ledges, sharp corners and other characteristics which tend to trap and hold foreign or undesirable material.

In general, depending on climate and other factors, the tank body, i.e., top and side wall, may consist of an inner layer which contacts the stored liquid and an outer skin with an intermediate insulation layer therebetween. The inner skin, being the one that is in contact with the milk or similar product, must be frequently cleaned and rinsed, usually after each use. In the milk industry, cleaning is accomplished by application to all milk-contacting surfaces of a special cleaning solution under substantial pressure. This solution is usually sprayed onto the inner surfaces of the tank by means of a high pressure spray nozzle located in the center of the usually conical top of the tank. The solution then flows or cascades down the slanted sides of the top and the cylindrical walls of the tank body to the bottom. The internal surfaces of all vent tubes and liquid conduits must also be cleaned, usually by being flooded by means of runoff from the tank or by pumps which force the cleaning solution through the system. However, the proper design of a silo tank requires that such tubes and conduits be cleanable and therefore compatible with the apparatus for cleaning the tank itself.

Cleaning of the interior of a large silo tank presents a formidable problem particularly when, as usually happens, the anciliary of the tank must also be cleaned without separation from the tank. The most important of such anciliary elements which must be cleaned include the atmospheric vents, overflow tubes, and antisiphon devices associated with the tank. Such devices are essential to proper operation of the tank. They function to protect the tank against damage due to overfill and vacuum induced collapse as mentioned above.

In utilization of silo type storage tanks, it is, of course, obvious that the tank is provided with suitable conduits and valves for filling and emptying the tank of its liquid contents. These are usually located at or near the bottom of the tank to facilitate handling and operation. The bottom of the tank is usually a drainable bottom which may be somewhat conical or merely slanted, so as to allow total drainage without retention of a reservoir or puddle of liquid. Many appropriate valves and bottoms for this purpose are known. The tanks are also provided with vent means which allow internal air to escape when the tank is being pumped full of a liquid product, such as milk, and to permit the entry of air when the tank is being drained. It should be noted that the development of a vacuum within the tank during drainage can, and often does, cause collapse of the tank due to pressure differential.

It will be appreciated that the cleaning apparatus, including the spray nozzle, is of particular importance to the proper design and functioning of the tank.

At the present time, the cleaning solution is pumped through a stainless steel conduit which usually loops up the outside of the tank to the top, passing through an oriface in the middle of the top, thence into a spray device which sprays the cleaning solution at high pressure onto the inside surface of the top of the tank. Since it is impractical to directly spray all inside surfaces, present day tanks rely on gravity flow of the cleaning solution to reach the lower walls and bottom of the tank.

It will be appreciated that the usual arrangement of conduits being located outside of the tank are often subject to malfunction due to freeze up which blocks the conduit, thus preventing proper venting and overflow. Moreover, the use of the cleaning solution conduits as a pressure vent is undesirable because of the restricted air flow resulting from the small apertures in the spray nozzle.

Accordingly, it is an object of this invention to provide a liquid storage tank, including cleaning means, which overcomes the disadvantages of existing silo-type tanks.

More particularly, a principal object of the invention is to simplify the construction of silo tanks by elimination of external iron work such as ladders, platforms, catwalks and the like.

Another object of the invention is to provide an easily accessible spray means and arrangement for introducing cleaning solution into the tank into contact with all internal surfaces.

A still further object of the invention is to provide easily cleanable vent and overflow means for use in silo tanks having the cleaning apparatus which forms part of this invention.

Another object of the invention is to provide a silo tank in which the conduits necessary for cleaning, venting and overfill prevention are protected against malfunction caused by freeze up and are independent of the spray nozzle.

SUMMARY OF THE INVENTION

These and other objects can be achieved by a silo tank which includes an upwardly directed high pressure cleaning spray nozzle located at or near the bottom of the tank aimed so that the spray will impinge on the inside surface of the tank top and then flow downwardly on the top and walls to be base, and, in addition, compatible venting and overfill prevention means which are operatively connectable with the cleaning apparatus so that they can be thoroughly cleaned and rinsed during the usual cleaning and rinsing operations.

In general, the vent conduits and overfill prevention means, sometimes referred to as overflow pipes or conduits, are operatively connected with the conduits leading to the spray nozzle so that they fill when the spray operation is in progress, thus achieving cleaning of all inside surfaces.

GENERAL DESCRIPTION OF DRAWINGS

The invention, its description, and the following claims will be more readily understood when considered in light of the accompanying drawings in which like numerals refer to like or functionally analogus elements:

DETAILED DESCRIPTION OF PREFERRED EMBODIMENTS

Figure 1:
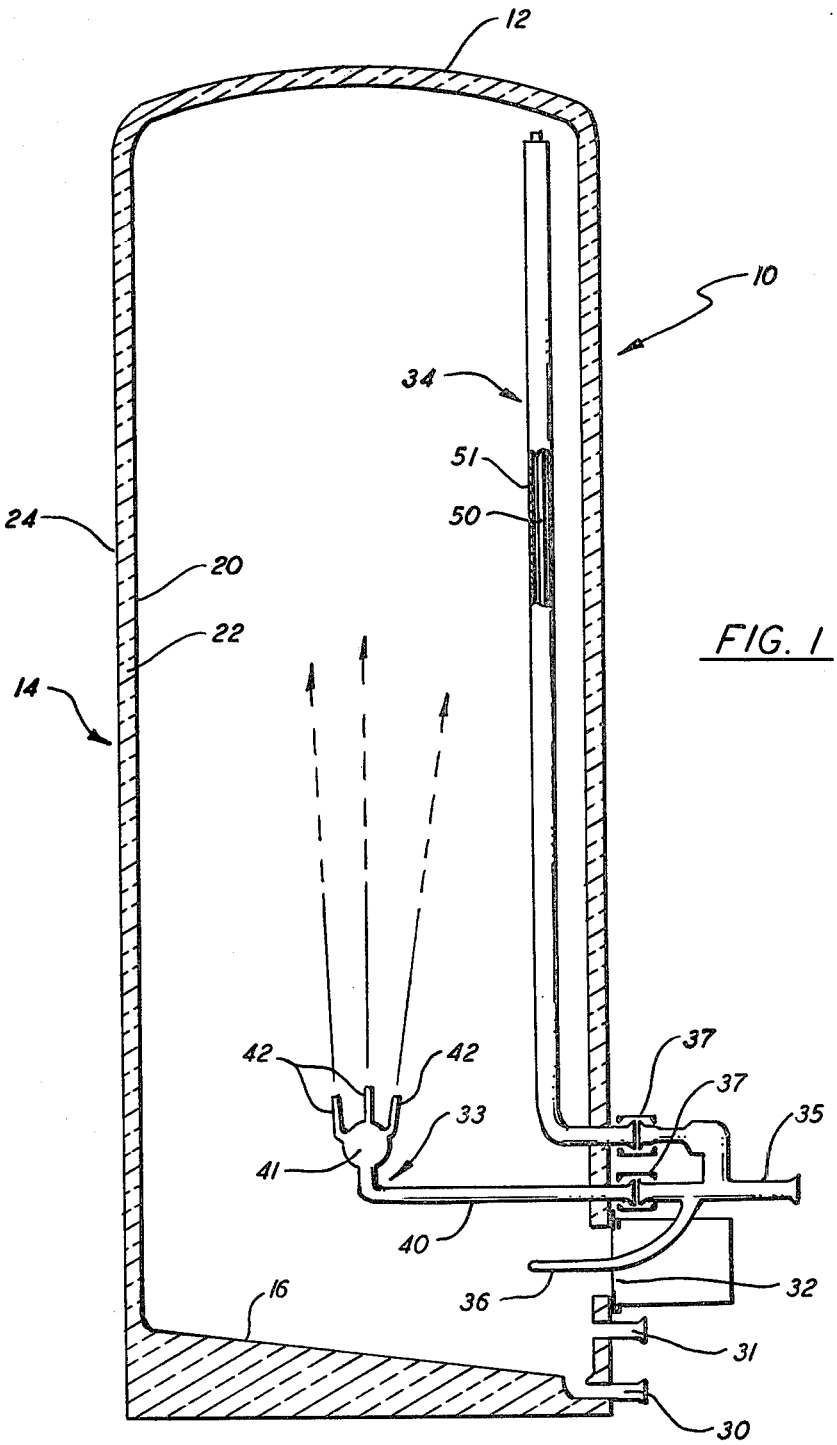
FIG. 1 is a schematic view, partially in cross section, of a silo tank embodying the invention.

FIG. 1 shows a silo tank 10 having a top 12, cylindrical side wall 14 extending upwardly from a drainable floor 16. The wall 14 and top 12 include inner and outer metal layers 20 and 24 respectively and a layer of insulating material 22, located therebetween tank 10, as shown, is equipped with a drain outlet 30, a filling inlet 31, a manhole 32, a spray unit 33, and relief means 34. Also shown is pump connector 35 which includes means for connecting the spray unit 33 and relief means 34 with a pump and a resevoir of cleaning solution (not shown). Extension 36 of connector 35 projects through the open manhole during spray cleaning operations in order to insure that the manhole door is open. This is an added safeguard to prevent damage to the walls of the tank due to rapid pressure changes when hot or cold cleaning and rinse liquids are pumped into or out of the tank.

Spray unit 33 includes conduit 40 spray head 41 and adjustable sprayer tubes 42 which are directed upwardly towards the top 12 of tank 10 in order to bathe the entire inner metal skin 20 of top and wall with the cleaning solution. When spray unit 33 is in operation, relief means 34 is also connected to the pump and cleaning solution resevoir, thus causing the cleaning solution to flow upwards through the relief means 34 thereby cleaning the inside of the relief means. When the tube 34 fills and overflows, the outside of tube 34 is bathed in the solution. Cleaning solution flowing down the wall 14 and across floor 16 is drained through drain 30 for reuse or discard as required. Connector 35 is secured to the various conduit orifices by means of any type of standard removable clamps shown schematically as 37. When the connector is removed after cleaning, it is replaced by a suitable seal well known in the art.

Relative sizes, diameters and other specifications of the various conduits leading from a pump and fluid resevoir can be selected as required to provide sufficient pressure and flow rate to clean all surfaces. Standard connectors and coupling means well known in the industry can be used to operatively connect the spray means and relief means to the source of liquid to be distributed about the tank interior.

Figure 2:
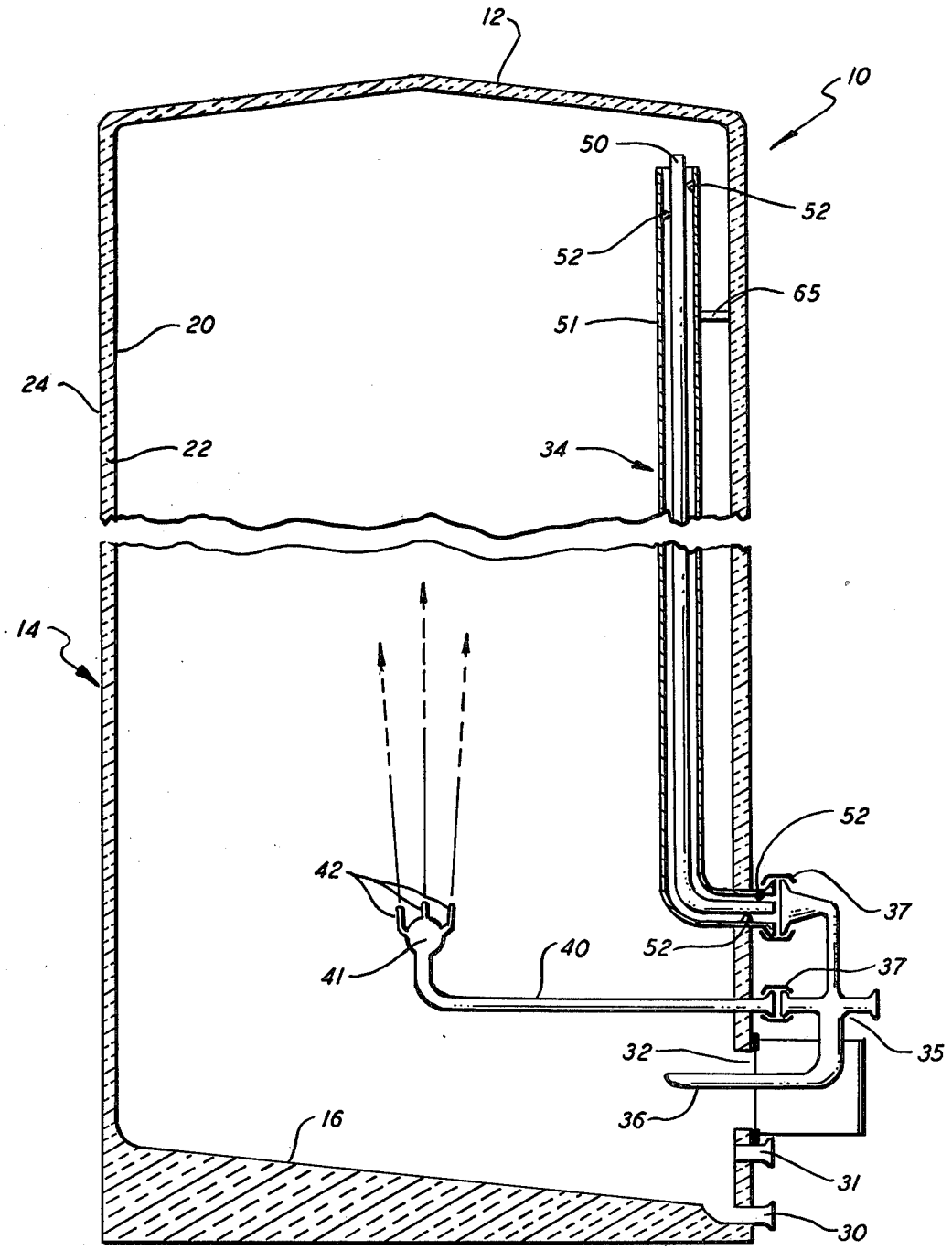
FIGS. 2 and 3 are schematic views, partially in cross section, of a tank of the invention.

In FIG. 2 relief means 34, as shown, includes an inner vent tube 50 and an outer overflow tube 51 with the vent tube 50 extending above the top orifice of outer tube 51. Spacers 52 are placed within the conduit of tube 52 in order to hold their relative positions.

Figure 3:
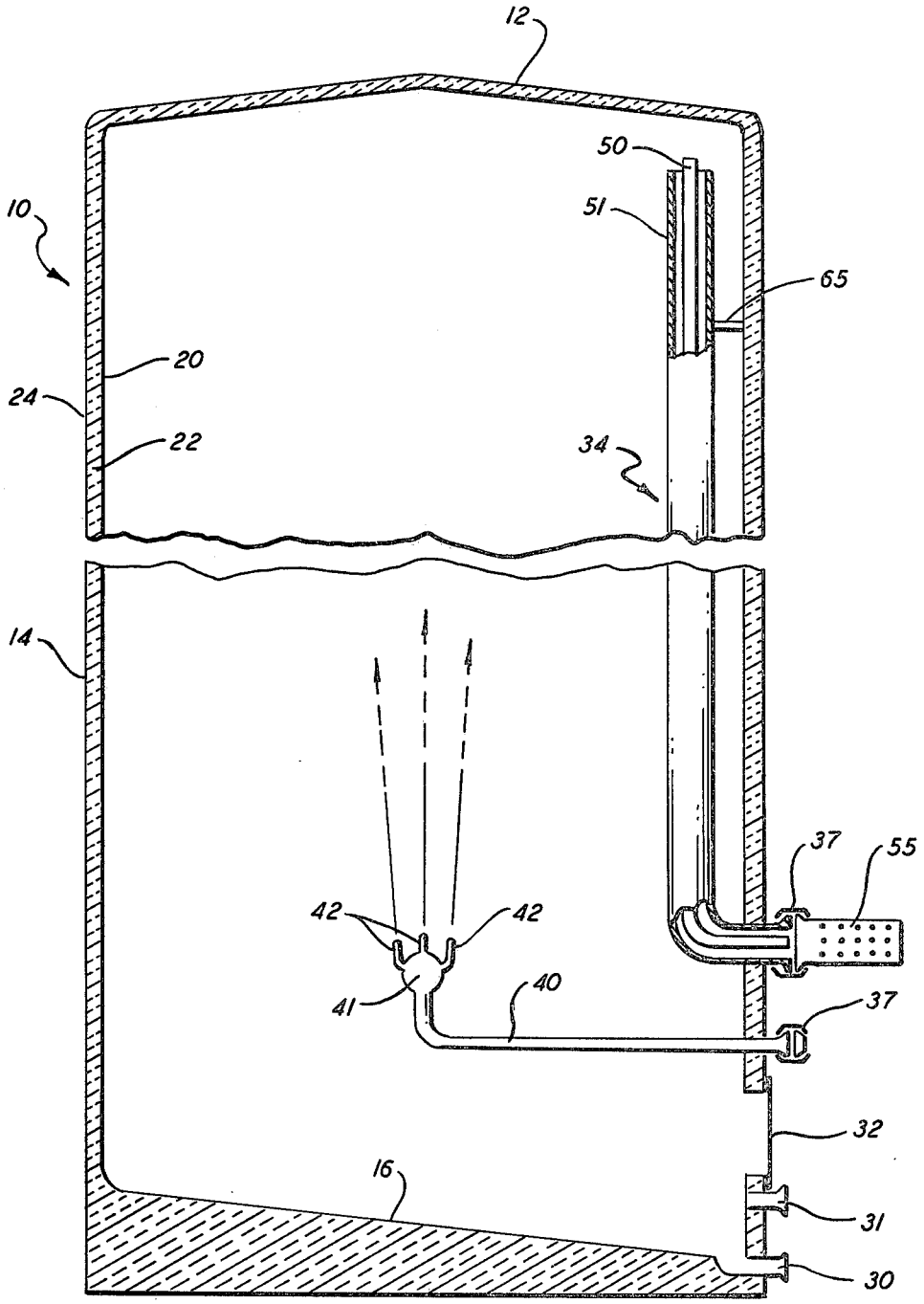
Figure 5:
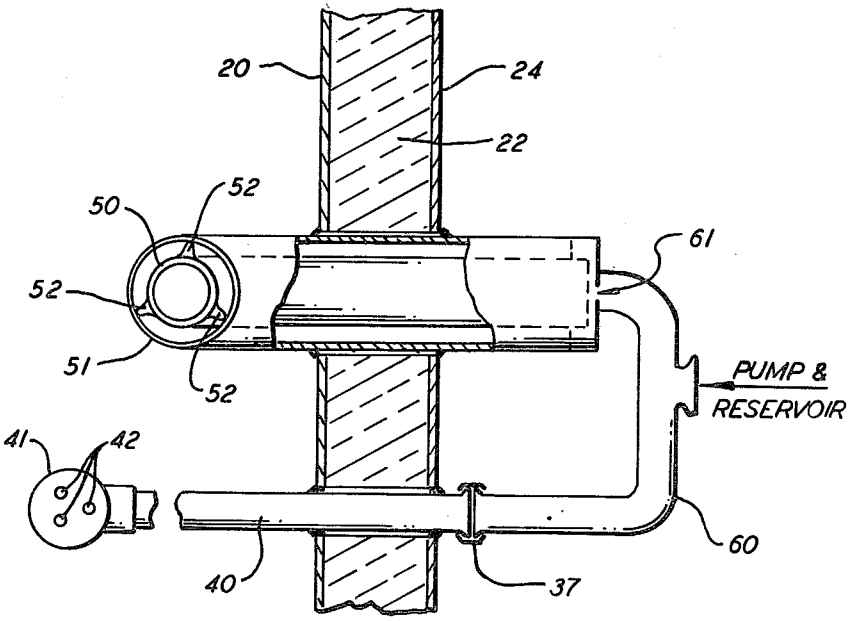
FIG. 5 is a plan view of the spray, vent, and overfill conduits of the invention.

FIG. 3 shows the tank unit of FIG. 2 with the connector assembly 35 removed and the tank in condition for milk or liquid storage. Screen or air filter 55 is shown in place over the outside orifice of tubes 50 and 51. This screen functions to filter impurities out of ambient air communicating with the inside of the tank through relief means, i.e., overflow vent 51 and pressure relief vent 50. Screen 55 is removable for cleaning and to provide for hook up of the pump and cleaning solution resevoir used during cleaning of the internal surfaces and components of the tank. The upper reaches of the relief means is supported by a brace 65 secured to the inner metal skin 20 of wall 14.

Figure 4:
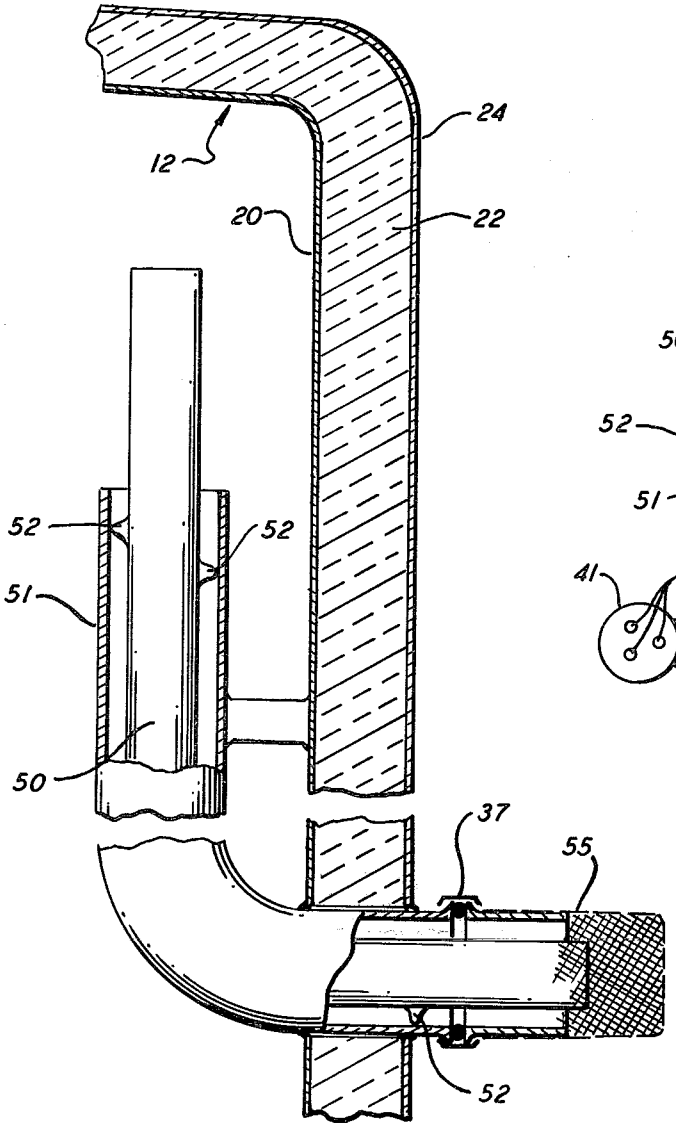
FIG. 4 is a schematic view, partially sectioned, of the vent and overfill elements of the invention.

FIG. 4 shows a manifold conduit 60 communicating with both spray unit 33 and the outer tube 51 and inner tube 50, the lower horizontal segment of which is shown in dotted lines. During a washing operation, cleaning solution is pumped into manifold 60 at a sufficient rate determined by the tank and conduit size parameters. A portion of cleaning solution volume is carried to spray head unit 41 and discharged upwardly to impinge on the top and thence flow down the sides. Another portion of cleaning solution passes through orifice 61 whence it fills first the narrow diameter tube 50 overflowing the top, thereby cleaning the outer surface of the segment extending beyond the top of tube 51. Tube 51 is filled and thereby cleaned by cleaning solution flowing upwardly from the manifold 61 and solution flowing downwardly from the overflow of tube 50.

Figure 6:
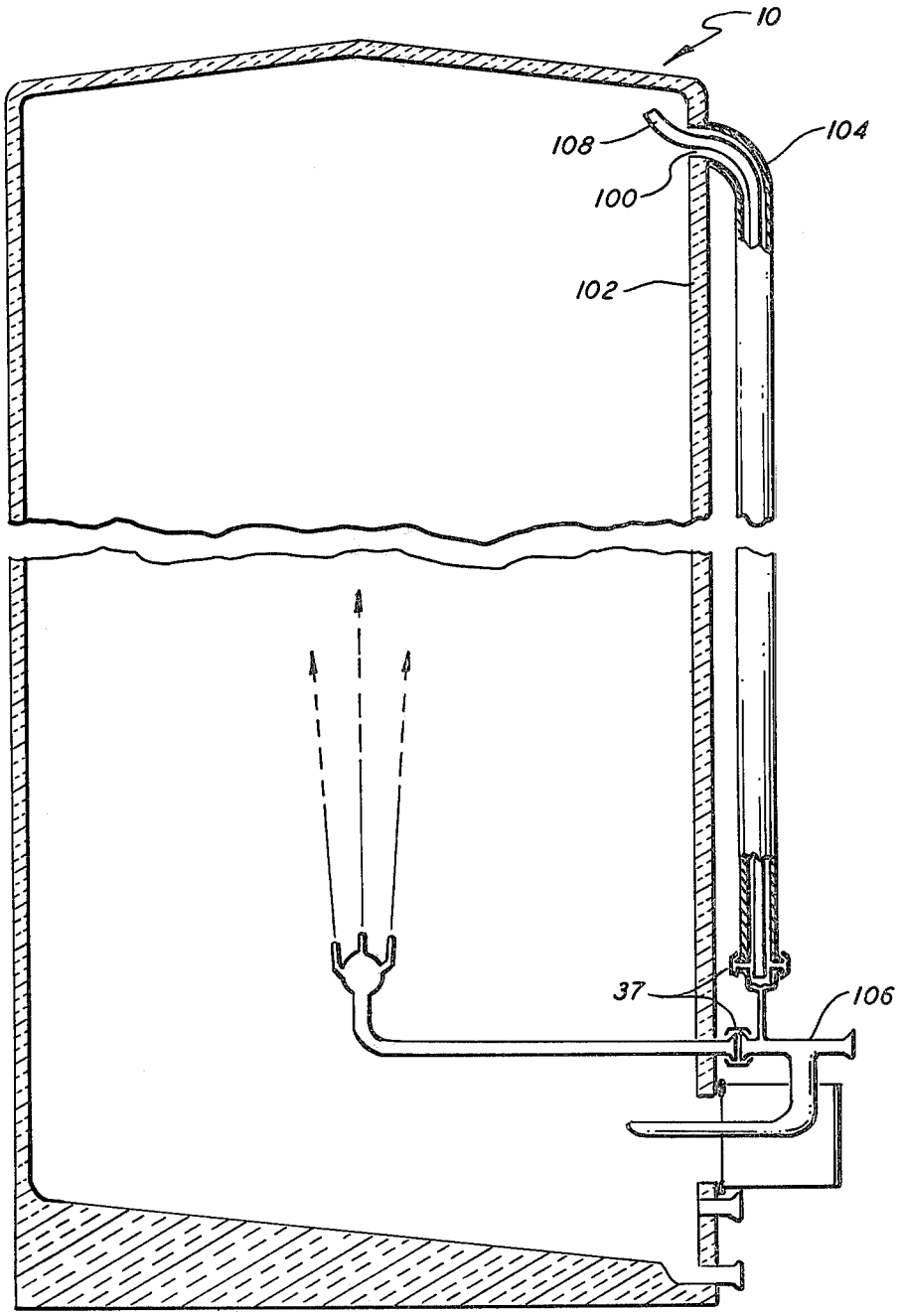
FIG. 6 is a schematic view, partially in cross section, of another embodiment of the invention.

FIG. 6 shows a modified double tube vent system in which the tubing is positioned outside of the tank cabity itself. Tank 10 is provided with a single aperture 100 in the upper portion of wall 102. Conduit 104 extends from aperture 100 and communicates with spray connector 106 by means of a standard coupling device not shown. Located within conduit 104 is another conduit shown as 108 which functions as a vent also communicating with spray connector 106, via standard connection devices. It is important that the pressure vent tube 108 extend beyond and above the overflow level of conduit 104 in order to avoid development of a vacuum within the tank and resulting in damage to the tank walls and top.

While the invention has been described in detail with particular reference to embodiments shown in the drawings, it will be understood and apparent that variations and modifications can be made within the scope of the particular descriptions and the appended claims.

As can be seen from the attached drawings, the invention comprises a vertical liquid storage tank in which the spray nozzle for the cleaning and rinsing liquids is located in the lower portion of the tank in communication with a conduit which extends inwardly from the lower wall, entering through an orifice in the wall. As used herein, including the appended claims, the term "lower portion" refers to the portion of the sidewall of the tank extending from the bottom of the tank to a height of about 4 to 6 feet above the bottom. Similarly, the term "upper portion" refers to that portion of the wall which extends from the point where the top joins the wall to about 1 to 2 feet below that point. As seen in the drawings, the so called double-tube vent and overflow arrangement of conduits extends upwardly from the lower portion of the sidewall to the upper portion of the sidewall on either the inner or outer side with the communicating orifice being suitably located in the sidewall. The spray nozzle, overflow conduit, vent are adapted to be attached by known clamps or connectors to a pump and a resevoir of cleaning or rinsing liquid. They can also be properly sealed or otherwise protected against contamination when disconnected from the pump.

The internal vent and overflow arrangement shown in FIGS. 1-3 is particularly advantageous in that the location of the conduits is compatible with refrigeration along with the contents of the tank. Since these conduits may be a place where bacteria can grow this location improves sanitation without a need for extra refrigeration coils as required for an external arrangement.

What is claimed:

1. A vertical tank of the silo-type for storage of liquids including a top, cylindrical sidewall, drainable bottom, and means for filling and draining said tank and also including cleaning means, vent means, and overfill prevention means; said cleaning means comprising an adjustable, upwardly directed spray nozzle for directing a spray of liquid onto the top of the tank, said nozzle positioned centrally with respect to the sidewall near the bottom of the tank on a conduit extending through said wall in communication with said nozzle; said overfill prevention means comprising a conduit extending upwardly from the lower portion of the sidewall to a predetermined point above which the tank can not be filled and communicating with the interior of the tank through an orifice in the sidewall; said vent means comprising a conduit extending upwardly from the lower portion of the sidewall to a point above the level of the overfill prevention conduit and communicating with the interior of the tank through an orifice in the sidewall thereof.

2. A tank according to claim 1 wherein the overfill prevention conduit and the vent conduit communicate with the interior of the tank through the same orifice.

3. A tank according to claim 2 wherein the orifice is located in the upper portion of the sidewall of the tank.

4. A tank according to claim 2 wherein the orifice is located in the lower portion of the sidewall of the tank.

5. A tank according to claim 2 wherein the overfill prevention conduit and the vent conduit are concentricly arranged.

6. A tank according to claim 5 wherein the concentricly arranged conduits enter the interior of the tank through an orifice located in the lower portion of the sidewall and extend upwardly within the tank.

* * * * *